US011584493B2

(12) United States Patent
Ideskog

(10) Patent No.: US 11,584,493 B2
(45) Date of Patent: Feb. 21, 2023

(54) METHOD AND SYSTEM FOR CONTROLLING PROPULSIVE POWER OUTPUT OF SHIP

(71) Applicant: YARA MARINE TECHNOLOGIES AS, Oslo (NO)

(72) Inventor: Linus Ideskog, Öckerö (SE)

(73) Assignee: YARA MARINE TECHNOLOGIES AS, Oslo (NO)

( * ) Notice: Subject to any disclaimer, the term of this patent is extended or adjusted under 35 U.S.C. 154(b) by 0 days.

(21) Appl. No.: 17/622,913

(22) PCT Filed: Jul. 1, 2020

(86) PCT No.: PCT/EP2020/068505

§ 371 (c)(1),
(2) Date: Dec. 27, 2021

(87) PCT Pub. No.: WO2021/001418

PCT Pub. Date: Jan. 7, 2021

(65) Prior Publication Data

US 2022/0242535 A1 Aug. 4, 2022

(30) Foreign Application Priority Data

Jul. 3, 2019 (SE) ..... 1950839-9

(51) Int. Cl.
*F02D 29/02* (2006.01)
*B63H 3/10* (2006.01)
(Continued)

(52) U.S. Cl.
CPC ..... *B63H 3/10* (2013.01); *B63H 21/14* (2013.01); *B63H 21/21* (2013.01); *B63H 21/22* (2013.01);
(Continued)

(58) Field of Classification Search
CPC ..... B63H 21/21; B63H 21/213; B63H 2021/216; B63H 21/22; B63H 3/10;
(Continued)

(56) References Cited

U.S. PATENT DOCUMENTS 5,070,832 A 12/1991 Hapka
5,392,741 A 2/1995 Uzkan
(Continued)

FOREIGN PATENT DOCUMENTS

JP S61291296 A 12/1986
WO 2016169991 A1 10/2016
WO 2019086086 A1 5/2019

OTHER PUBLICATIONS

Claudiu Nichita: "X-DF TEchnology", SNAME, Jan. 9, 2018 (Jan. 9, 2018), XP55733787, Retrieved from the Internet: URL:https://higherlogicdownload.s3.amazonaws.com/SNAME/442597fa-7d01-48c2-83e8-dfe93adfd043/UploadedFiles/RXmW7oXDTAuLHllnsjhd_20180109%20X-DP/020Technology/020@/020SNAME,/020London/0202018.pdf [retrieved on Sep. 24, 2020].
(Continued)

*Primary Examiner* — Andrew Polay
(74) *Attorney, Agent, or Firm* — Dilworth IP, LLC

(57) ABSTRACT

A method and a system for controlling a propulsive power output applied to a propeller shaft of a ship. If a current value of a propulsive power of a propulsive power source equals or falls below a lower power limit value, and/or if a current value of an operational parameter reaches a first/lower parameter limit value, a control unit is configured to: increase a power output of an internal combustion engine of the propulsive power source. Thus, operation of the engine below a lower power limit is avoided.

24 Claims, 3 Drawing Sheets

(51) Int. Cl.

| | |
|---|---|
| ***B63H 21/22*** | (2006.01) |
| ***B63H 23/12*** | (2006.01) |
| ***F02D 41/00*** | (2006.01) |
| ***B63H 21/14*** | (2006.01) |
| ***B63H 21/21*** | (2006.01) |
| *F02D 25/00* | (2006.01) |
| *F02D 41/14* | (2006.01) |

(52) U.S. Cl.
CPC ..... *B63H 23/12* (2013.01); *F02D 41/0007* (2013.01); *B63H 2021/216* (2013.01); *F02D 25/00* (2013.01); *F02D 29/02* (2013.01); *F02D 41/1446* (2013.01); *F02D 2200/021* (2013.01); *F02D 2200/0406* (2013.01)

(58) Field of Classification Search
CPC ..... B63H 21/14; B63H 23/12; F02D 41/0007; F02D 2250/34; F02D 25/00; F02D 29/02; F02D 2200/0406
See application file for complete search history.

(56) References Cited

U.S. PATENT DOCUMENTS

| | | | | |
|---|---|---|---|---|
| 6,401,457 | B1 | 6/2002 | Wang | |
| 6,415,761 | B1 | 7/2002 | McKenzie | |
| 9,868,501 | B1 | 1/2018 | Gable | |
| 11,352,118 | B1 | 6/2022 | Dengel | |
| 2002/0099496 | A1 | 7/2002 | Weisman | |
| 2002/0162533 | A1 | 11/2002 | Houchin | |
| 2004/0121666 | A1* | 6/2004 | Okuyama | F02N 11/0803 440/85 |
| 2005/0049819 | A1 | 3/2005 | Longnecker | |
| 2006/0042241 | A1 | 3/2006 | Bright | |
| 2006/0100755 | A1 | 5/2006 | Kustosch | |
| 2007/0293103 | A1 | 12/2007 | Kinoshita | |
| 2009/0151337 | A1 | 6/2009 | Tornambe | |
| 2010/0168942 | A1 | 7/2010 | Noffsinger | |
| 2010/0274420 | A1 | 10/2010 | Veit | |
| 2012/0277941 | A1 | 11/2012 | Noffsinger | |
| 2014/0067236 | A1 | 3/2014 | Henry | |
| 2014/0336852 | A1 | 11/2014 | Ozolins | |
| 2015/0219034 | A1 | 8/2015 | Boettcher | |
| 2017/0051692 | A1 | 2/2017 | Zhang | |
| 2017/0129511 | A1 | 5/2017 | Crane | |
| 2017/0268439 | A1 | 9/2017 | Ahuja | |
| 2018/0001985 | A1 | 1/2018 | Zhang | |
| 2018/0050782 | A1* | 2/2018 | Danielsson | B63H 21/14 |
| 2018/0148034 | A1 | 5/2018 | Ideskog | |
| 2018/0306125 | A1 | 10/2018 | Renold-Smith | |
| 2018/0313282 | A1 | 11/2018 | Pati | |
| 2018/0327052 | A1 | 11/2018 | Van Miert | |
| 2019/0140454 | A1 | 5/2019 | Chase | |
| 2019/0301360 | A1* | 10/2019 | Murakami | F02B 43/02 |
| 2020/0039623 | A1 | 2/2020 | Mikalsen | |
| 2020/0056558 | A1 | 2/2020 | Weber | |
| 2020/0149996 | A1 | 5/2020 | Seenumani | |
| 2020/0223522 | A1 | 7/2020 | Ideskog | |

OTHER PUBLICATIONS

International Preliminary Report on Patentability for App. No. PCT/EP2020/068505, dated Dec. 3, 2021, 30 pages.
International Search Report for App. No. PCT/EP2020/068505, dated Oct. 13, 2020, 4 pages.
Written Opinion for App. No. PCT/EP2020/068505, dated Oct. 13, 2020, 7 pages.
International Preliminary Report on Patentability for App. No. PCT/EP2020/068509, dated Dec. 3, 2021, 26 pages.
International Search Report for App. No. PCT/EP2020/068509, dated Oct. 6, 2020, 4 pages.
Written Opinion for App. No. PCT/EP2020/068509, dated Oct. 6, 2020, 7 pages.
"Dynamic Cylinder Cutout", Research Disclosure, Kenneth Mason Publications, Hampshire, UK, GB, vol. 611, No. 33, Mar. 1, 2015 (Mar. 1, 2015), p. 7, XP007143917, ISSN: 0374-4353, (retrieved on Feb. 5, 2015).
Office Action dated Jun. 22, 2022 for U.S. Appl. No. 17/622,932 (pp. 1-53).
Office Action dated Jul. 5, 2022 for U.S. Appl. No. 17/622,932 (pp. 1-48).
Office Action (Final Rejection) dated Sep. 12, 2022 for U.S. Appl. No. 17/622,932 (pp. 1-43).
SG Written Opinion issued in App. No. SG11202113722Y, dated Sep. 22, 2022, 6 pages.

* cited by examiner

METHOD AND SYSTEM FOR CONTROLLING PROPULSIVE POWER OUTPUT OF SHIP

TECHNICAL FIELD

The invention relates to a method of controlling a propulsive power output applied to a propeller shaft of a ship, and to a system for controlling a propulsive power output applied to a propeller shaft of a ship. The invention further relates to a computer program and a computer-readable storage medium comprising instructions which, when executed by a computer, cause the computer to carry out a method of controlling a propulsive power output applied to a propeller shaft of a ship.

BACKGROUND

A ship comprises a propulsive power source which is connected with a propeller via a propeller shaft. In this manner, the propulsive power source is arranged to propel the ship.

The propulsive power source comprises at least one internal combustion engine, ICE. Such a ship is a large ship used e.g. in commercial traffic, such as e.g. a tanker, a RORO vessel, a passenger ferry, or a coastal vessel just to name a few examples.

The propulsion of the ship is controlled from its bridge. There, personnel have access to support information for controlling the ship. The information may be provided e.g. via one or more of maps, instruments, and ship internal communication devices. Control devices for controlling speed and course of the ship are also provided on the bridge.

WO2019/011779 discloses a user board and a control unit for controlling the propulsion of a ship comprising an engine and a controllable pitch propeller. Torque and engine speed are adjusted to correspond to an output setpoint value. The adjustment is such that said ship is operated in an operating condition with an engine speed of said engine and a propeller pitch of said controllable pitch propeller such that the fuel consumption of said ship is brought and/or held within a desired fuel consumption range. The output setpoint value may be set using the user board.

JP S 61291296 A, discloses an automatic speed control method with double-engine one-shaft type propeller. In order to exercise a broad speed control, by using two engines of a double-engine one-shaft type separately, and expanding the scope of the total output without changing the output area of a single engine. When a practical ship speed signal is larger than a setting ship speed signal, both engines are controlled in the decelerating direction, and when the output comes to 40% of the rating speed, a clutch releases one of the engines the output of the other engine is controlled increase to 80%. When the practical ship speed is smaller, the output of the other engine is increased, and when it comes up to 85%, the stopped engine is started and both engines are controlled at a revolution of 42.5% output, and the clutch is connected to convert to double-engine drive, without changing the output before and after the converting. The automatic speed control method is based on measured rotational speed of the two engines. Claudiu Nichita: "X_DF Technology", SNAME, 9 Jan. 2018, XP055733787, discloses inter alia engine rating fields of marine diesel engines. WO 2016/169991 discloses a method for controlling the fuel consumption of a ship. The ship comprising an engine and a controllable pitch propeller, wherein torque and engine speed are adjusted to correspond to an output set point value.

The adjustment is such that the engine is operated in an operating condition with an engine speed and a propeller pitch of the controllable pitch propeller such that the fuel consumption of the ship is brought and/or held within a desired fuel consumption range.

SUMMARY

It would be advantageous to achieve a method of, and/or a system for, controlling a propulsive power applied to the propeller shaft of a ship, which enables not only taking account of propulsive power produced by the propulsive power source but also to the operation of an internal combustion engine of the propulsive power source.

According to an aspect of the invention, there is provided a method according to claim 1. The method is a method of controlling a propulsive power output applied to a propeller shaft of a ship, the ship comprising a propulsive power source and the propeller shaft. The propulsive power source comprises an internal combustion engine connected to the propeller shaft. The method comprises steps of:

- producing a propulsive power by means of the propulsive power source,
- determining a current value of the propulsive power of the propulsive power source,
- determining a current value of an operational parameter of the internal combustion engine, the operational parameter being a different parameter than the propulsive power,
- comparing the current value of the propulsive power with a lower power limit value, and
- comparing the current value of the operational parameter with a first parameter limit value. If the current value of the propulsive power equals or falls below the lower power limit value, and/or if the current value of the operational parameter reaches the first parameter limit value, the method comprises a step of:
- increasing a power output of the internal combustion engine.

Since the method comprises the step of increasing the power output of the internal combustion engine, ICE, which step is performed not only when the current value of the propulsive power equals or falls below the lower power limit value, but also if the current value of the operational parameter reaches the first parameter limit value, the method of controlling the propulsive power output takes account of the operating conditions of the ICE of the propulsive power source for preventing the ICE from being operated under unfavourable low power output conditions.

According to a further aspect of the invention, there is provided a system according to claim 14. The system is a system for controlling a propulsive power output applied to a propeller shaft of a ship, the system comprising a propulsive power source and a control arrangement. The propulsive power source comprises an internal combustion engine connected to the propeller shaft. The control arrangement comprises a control unit, at least one sensor for sensing at least one operational parameter of the internal combustion engine, and at least one power output measuring device of the propulsive power source. The control unit is configured to:

- determine a current value of a propulsive power of the propulsive power source utilising the power output measuring device,
- determine a current value of an operational parameter of the internal combustion engine utilising the at least one sensor, the operational parameter being a different parameter than the propulsive power, compare the current value of the propulsive power with a lower power limit value, and compare the current value of the operational parameter with a first parameter limit value. If the current value of the propulsive power equals or falls below the lower power limit value, and/or if the current value of the operational parameter reaches the first parameter limit value, the control unit is configured to:

increase a power output of the internal combustion engine.

Similarly, as discussed above in connection with the method, since the control unit of the system is configured to increase the power output of the ICE not only when the current value of the propulsive power equals or falls below the lower power limit value, but also if the current value of the operational parameter reaches the first parameter limit value, the system for controlling the propulsive power output takes account also of the current operating conditions of the ICE of the propulsive power source for preventing the ICE from being operated under unfavourable low power output conditions.

The first parameter limit value represents a value of the operational parameter indicating that the ICE is operated at a lower power output level of the ICE, i.e. a level, which when the ICE is operated below it, may e.g. harm the ICE and/or cause the ICE to operate erratically and/or inefficiently.

More specifically, the propulsive power source, which is connected to the propeller shaft of the ship, provides propulsive power to the propeller shaft within a power window. The power window is defined by the lower power limit value and an upper power limit value. As the ship travels, i.e. as the ship is propelled by the propulsive power source, the current propulsive power output applied to the propeller shaft from the propulsive power source is monitored and the propulsive power source is controlled such that the propulsive power applied to the propeller shaft remains within the power window. In connection with controlling the propulsive power of the propulsive power source, the lower power limit value may form a lower setpoint and the upper power limit value may form an upper setpoint. Operating the propulsive power source outside the power window, at least for longer periods of time may harm the ICE and/or cause the ICE to operate inefficiently.

In practice, this means that the propulsive power source is controlled such that the propulsive power applied to the propeller shaft cannot exceed the upper power limit value and cannot fall below the lower power limit value, at least not for any longer periods of time. Suitably, control means used by personnel on the bridge of the ship for controlling the propulsive power source is configured for restricting the propulsive power applied to be propeller shaft within the power window.

Traditionally, such control means have ranged from, in its simplest form, direct communication between personnel on the bridge and engine operating personnel in an engine room of the ship, to safety systems which automatically prevent the propulsive power source from exceeding the upper power limit value.

It has been realised by the inventor that it would be beneficial if a lower power output of a propulsive power source not only is defined by a predetermined lower power limit value of the propulsive power source, but also by an operating state of the ICE of the propulsive power source. Namely, depending on the operating state of the ICE, operating the propulsive power source at a set predetermined lower power limit value may lead to an unfavourable operation of the ICE. More specifically, under particular operating conditions of the ship, such as e.g. under particular sea and/or weather conditions, and/or under particular operating conditions of the ICE, e.g. caused by maintenance requirements of the ICE, and/or fuel energy content (depending e.g. on used fuel type), applying a propulsive power output to the propeller shaft close to the lower power limit value of the propulsive power source, will harm the ICE, and/or cause it to operate inefficiently and/or in an environmentally harmful manner and/or erratically. Whereas, under normal operating conditions of the ship and with an ICE that has recently been serviced, the lower power limit value of the propulsive power source would provide safe operation of the ICE. Thus, in accordance with the invention, comparing not only the current value of the propulsive power with the lower power limit value, but also comparing the current value of the operational parameter of the ICE with the first parameter limit value, unfavourable operation of the ICE is prevented by increasing the power output of the internal combustion engine. Thus, the ICE is operated above its lower power output level.

The ship may be a large ship used e.g. in commercial traffic, such as e.g. a tanker, a RORO vessel, a passenger ferry, or a coastal vessel. The length of the ship may be at least 90 m. Typically, deadweight tonnage of the ship may be at least 4200 tonnes. The maximum power output of the propulsive power source may be at least 3 MW. The maximum power output of the propulsive power source may be within a range of 3-85 MW. The maximum power output of the ICE may be at least 2 MW.

The propulsive power source comprises at least one ICE. According to some embodiments, the propulsive power source comprises at least one further ICE, i.e. at least two ICEs, connected to the propeller shaft.

The control arrangement may be dedicated for performing the control of the propulsive power output applied to a propeller shaft discussed herein. Alternatively, the control arrangement may be configured for performing further control tasks related to the propulsion of the ship and/or to the ICE. Similarly, the control unit may be a dedicated control unit for performing the control discussed herein. Alternatively, the control unit may be configured for performing further control tasks. According to a further alternative, the control unit may be a distributed control unit, i.e. it may comprise more than one processor or similar device, which are configured to collectively perform the control discussed herein.

The current value of the propulsive power may alternatively be referred to as the momentary value of the propulsive power or the prevailing value of the propulsive power. Similarly, the current value of the operational parameter may alternatively be referred to as the momentary value of the operational parameter or the prevailing value of the operational parameter.

As mentioned above, the first parameter limit value represents a value of the operational parameter, which value indicates that the ICE is operated at a lower power output level.

Depending on the particular operational parameter, falling below, or exceeding, the first parameter limit value indicates that the operational parameter has reached a value indicating the lower power output level of the ICE. See further below with reference to the discussion of the various example operational parameters.

Accordingly, the term reaches, in the context of that the current value of the operational parameter reaches the first parameter limit value, means that the operational parameter equals or falls below, respectively exceeds, the first parameter limit value. The operational parameter reaches the first parameter limit value from a level of the operational parameter corresponding to a level above the lower power output level of the ICE.

According to embodiments of the method, wherein if the current value of the operational parameter reaches the first parameter limit value, the method may comprise a step of:

increasing the lower power limit value. In this manner, the lower power limit value of the propulsive power source may be adapted to the current operating conditions of the ICE, and the control of the propulsive power output applied to a propeller shaft may be based mainly on the comparison of the current value of the propulsive power with the updated, i.e. increased, lower power limit value.

According to embodiments of the method, wherein the step of increasing the lower power limit has been performed, the method may comprise a step of:

indicating visually and/or audibly an increase of the lower power limit value. In this manner, personnel may be made aware of changed operating conditions of the ship. The speed range of the ship has been decreased by the increase of the lower power limit value and thus, also the conditions under which the ship may be controlled.

According to embodiments, the method may comprise an optional step of:

determining a current value of a further operational parameter of the internal combustion engine, the further operational parameter being a different parameter than the propulsive power, wherein the method may comprise steps of:

comparing the current value of the propulsive power with an upper power limit value, and comparing the current value of the operational parameter or the current value of the further operational parameter with a second parameter limit value. If the current value of the propulsive power equals or exceeds the upper power limit value, and/or if the current value of the operational parameter or the current value of the further operational parameter reaches the second parameter limit value, the method may comprise a step of:

reducing a power output of the internal combustion engine. In this manner, the ICE of the propulsive power source may be prevented from being operated under unfavourable high power output conditions. Namely, since the method comprises the step of reducing a power output of the ICE, which step is performed not only when the current value of the propulsive power equals or exceeds the upper power limit value, but also if the current value of the operational parameter or of the further operational parameter reaches the second parameter limit value, the method of controlling the propulsive power output takes account of the operating conditions of the ICE of the propulsive power source for preventing the ICE from being operated under unfavourable high power output conditions.

The second parameter limit value represents a value of the operational parameter, or of the further operational parameter, indicating that the ICE is operated at an upper power output level of the ICE, i.e. a level, which when the ICE is operated above it, may e.g. harm the ICE and/or cause the ICE to operate erratically and/or inefficiently.

Depending on the particular operational parameter, exceeding the second parameter limit value indicates that the operational parameter, or the further operational parameter, has reached a value indicating the upper power output level of the ICE. See further below with reference to the discussion of the various example operational parameters.

Accordingly, the term reaches, in the context of that the current value of the operational parameter, or the further operational parameter, reaches the second parameter limit value, means that the operational parameter equals or exceeds the second parameter limit value. The operational parameter reaches the second parameter limit value from a level of the operational parameter corresponding to a level below the upper power output level of the ICE.

As indicated above, the operational parameter that is utilised in the step of comparing the current value of the operational parameter with the second parameter limit value may be the same operational parameter that is utilised in the step of comparing the current value of the operational parameter with the first parameter limit value. Alternatively, the operational parameter that is utilised in the step of comparing the current value of the operational parameter with the second parameter limit value may be a different operational parameter, i.e. a further operational parameter, than that which is utilised in the step of comparing the current value of the operational parameter with the first parameter limit value.

According to embodiments of the method, wherein if the current value of the operational parameter or the current value of the further operational parameter reaches the second parameter limit value, the method may comprise a step of:

reducing the upper power limit value. In this manner, the upper power limit value of the propulsive power source may be adapted to the current operating conditions of the ICE, and the control of the propulsive power output applied to a propeller shaft may be based mainly on the comparison of the current value of the propulsive power with the updated, i.e. reduced, upper power limit value.

According to embodiments of the method, wherein the step of reducing the upper power limit value has been performed, the method may comprise a step of:

indicating visually and/or audibly a reduction of the upper power limit value. In this manner, personnel may be made aware of changed operating conditions of the ship. The speed range of the ship has been decreased by the reduction of the upper power limit value and thus, also the conditions under which the ship may be controlled.

According to embodiments of the method, wherein the propulsive power source comprises a further internal combustion engine connected to the propeller shaft, the step of increasing the power output of the internal combustion engine may comprise a step of:

reducing a power output of the further internal combustion engine. In this manner, the step of reducing the power output of the further ICE may provide for the power output of the ICE to be increased in order to maintain the same propulsive power output applied to the propeller shaft of the ship as before the reduction of the power output of the further ICE. That is, the ICE compensates for the reduction of the power output of the further ICE and thus, the step of increasing the power output of the ICE may be accomplished.

According to embodiments of the method, wherein the propulsive power source comprises a further internal combustion engine connected to the propeller shaft, the step of reducing a power output of the internal combustion engine may comprise a step of:

increasing a power output of the further internal combustion engine. In this manner, the step of increasing the power output of the further ICE may provide for the power output of the ICE to be reduced in order to maintain the same propulsive power output applied to the propeller shaft of the ship as before the increase of the power output of the further ICE. That is, the ICE compensates for the increase of the power output of the further ICE and thus, the step of reducing the power output of the ICE may be accomplished.

According to the invention, wherein the internal combustion engine comprises at least one cylinder arrangement and a turbocharger, wherein the cylinder arrangement comprises a combustion chamber, a cylinder bore, a piston configured to reciprocate in the cylinder bore, a gas inlet connected to the combustion chamber, and a gas outlet connected to the combustion chamber, wherein the gas outlet is connected to a turbine side of the turbocharger and the gas inlet is connected to a compressor side of the turbocharger, the operational parameter, and/or optionally the further operational parameter, relates to the turbocharger, and/or optionally to the cylinder arrangement. In this manner, the operational parameter and/or the further operational parameter may relate to an operational parameter of the ICE, by means of which operation at the lower and/or upper power output level of the ICE may be identified.

According to embodiments of the system, the control unit may be optionally configured to:

determine a current value of a further operational parameter of the internal combustion engine, the further operational parameter being a different parameter than the propulsive power. The control unit may be configured to:

compare the current value of the propulsive power with an upper power limit value, and compare the current value of the operational parameter or a current value of a further operational parameter with a second parameter limit value. If the current value of the propulsive power equals or exceeds the upper power limit value, and/or if the current value of the operational parameter or the current value of the further operational parameter reaches the second parameter limit value, the control unit may be configured to:

reduce a power output of the internal combustion engine. In this manner, as discussed above with reference to the method, the ICE of the propulsive power source may be prevented from being operated under unfavourable high power output conditions. Namely, since the control unit is configured to reduce a power output of the ICE, which is performed not only when the current value of the propulsive power equals or exceeds the upper power limit value, but also if the current value of the operational parameter reaches the second parameter limit value, the system for controlling the propulsive power output takes account of the operating conditions of the ICE of the propulsive power source for preventing the ICE from being operated under unfavourable high power output conditions.

According to a further aspect of the invention, there is provided a computer program comprising instructions which, when the program is executed by a computer, cause the computer to carry out the steps of the method according to any one of aspects and/or embodiments discussed herein.

According to a further aspect of the invention, there is provided a computer-readable storage medium comprising instructions which, when executed by a computer, cause the computer to carry out the steps of the method according to any one of aspects and/or embodiments discussed herein.

Further features of, and advantages with, the invention will become apparent when studying the appended claims and the following detailed description.

BRIEF DESCRIPTION OF THE DRAWINGS

Various aspects and/or embodiments of the invention, including its particular features and advantages, will be readily understood from the example embodiments discussed in the following detailed description and the accompanying drawings, in which.

DETAILED DESCRIPTION

Aspects and/or embodiments of the invention will now be described more fully. Like numbers refer to like elements throughout. Well-known functions or constructions will not necessarily be described in detail for brevity and/or clarity.

Figure 1:
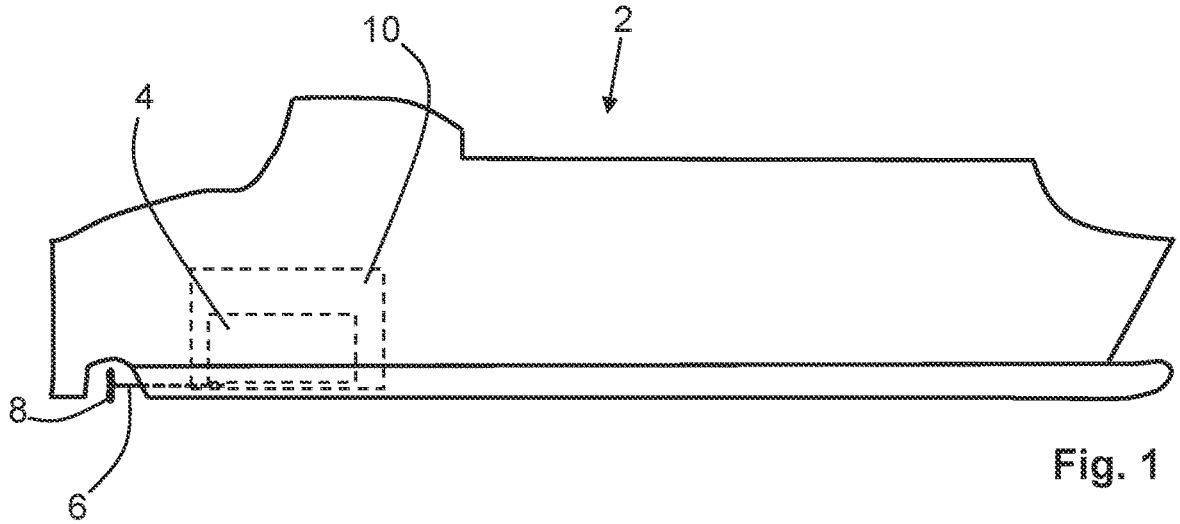
FIG. 1 illustrates a ship according to embodiments.

FIG. 1 illustrates a ship 2 according to embodiments. The ship 2 is configured for used in commercial traffic, such as for passenger transport and/or goods transport.

The ship 2 comprises a propulsive power source 4, a propeller shaft 6, and a propeller 8. The propulsive power source 4 is connected to the propeller shaft 6 and configured for applying a propulsive power output to the propeller shaft 6. The propeller 8 is connected to the propeller shaft 6. Thus, the propulsive power source 4 is arranged to propel the ship 2.

Further, the ship 2 comprises a system 10 for controlling a propulsive power output applied to the propeller shaft 6.

In these embodiments, the ship 2 comprises only one propeller shaft 6 and only one propulsive power source 4. In alternative embodiments, the ship 2 may comprise one or more further propeller shafts, and one further propulsive power source connected to each of the further propeller shafts.

Figure 2:
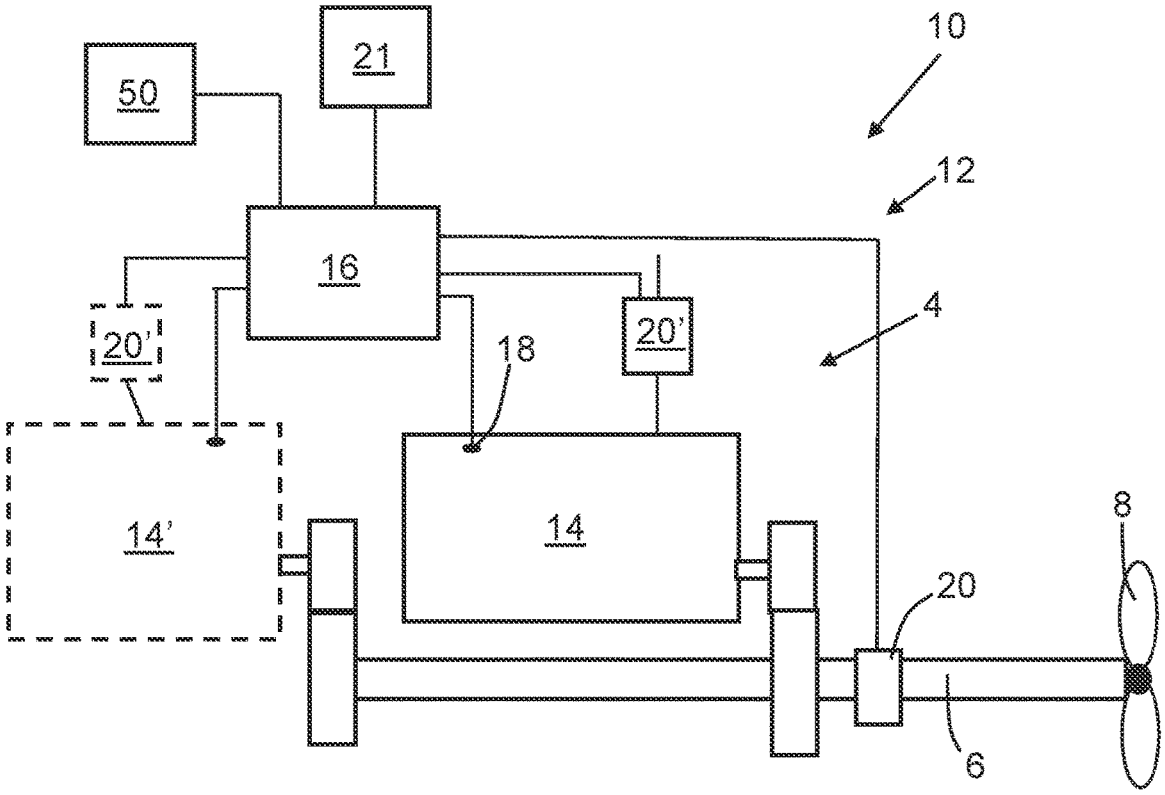
FIG. 2 schematically illustrates a system for controlling a propulsive power output applied to a propeller shaft of a ship, FIG. 3 schematically illustrates a cross section through an internal combustion engine.

FIG. 2 schematically illustrates a system 10 for controlling a propulsive power output applied to a propeller shaft 6 of a ship. The ship may be a ship 2 as discussed above with reference to FIG. 1.

The system 10 comprise a propulsive power source 4 and a control arrangement 12. The propulsive power source 4 comprises an internal combustion engine, ICE, 14 connected to the propeller shaft 6 of the ship.

The control arrangement 12 comprises a control unit 16, at least one sensor 18 for sensing at least one operational parameter of the ICE 14, and at least one power output measuring device 20, 20' of the propulsive power source 4.

In FIG. 2 two power output measuring devices 20, 20' are shown. A first power output measuring device 20 may comprise a torque meter configured to measure a torque applied to the propeller shaft 6. With knowledge about the angular velocity, w, of the propeller shaft 6, e.g. provided by a rotational speed meter or calculated from rotational speed data of the ICE 14, the propulsive power output applied to the propeller shaft 6 may be calculated. A second power measuring device 20' may comprise a fuel rack position sensor, by means of which the amount of fuel injected into the ICE 14 is estimated. For instance, the estimated amount of fuel injected into the ICE 14 and the rotational speed of the ICE 14 may provide a measure of the propulsive power output applied to the propeller shaft 6.

The control arrangement 12 may comprise only one of the shown power output measuring devices 20, 20' or both. In the latter case the measurements provided by the power output measuring devices 20, 20' may complement each other.

According to some embodiments, the propulsive power source 4 may comprise a further ICE 14' connected to the propeller shaft 6, as indicated by the ICE 14' drawn with broken lines. In such embodiments, the second power measuring device 20' of the propulsive power source 4 would comprise a fuel rack position sensor also for the further ICE 14'.

The invention is not limited to a particular type of output measuring device. Accordingly, alternatively or additionally, the control arrangement 12 may comprise a different output measuring device than discussed above. Further examples of output measuring devices may comprise other means for determining the amount of fuel injected into the ICE 14 or ICE:s 14, 14' than a fuel rack position sensor, such as a mass flowmeter or volume flowmeter on a fuel line, or mean cylinder pressure determining means in conjunction with a rotational speed sensor of the ICE 14. In case the output measuring device is configured to provide measurements related to the ICE 14 or ICE:s 14, 14', the propulsive power output of the propulsive power source may be estimated based on known losses in transmissions and known power take off power consumption connected to the ICE 14 or ICE:s 14, 14'.

Each of the ICE 14 and the further ICE 14' may be a large diesel engine. Each of the ICE 14 and the further ICE 14' may be a 2-stroke or a 4-stroke engine.

The propulsive power source 4 has a power window within which the propulsive power source 4 may be operated. The power window is defined by a lower power limit value and an upper power limit value. The lower and upper power limit values may be set in the control unit 16. The control unit 16 is configured to maintain the power output of the propulsive power source 4 applied to the propeller shaft 6 within the power window.

A user interface 21 may be connected to the control unit 16. The user interface 21 may be arranged on a bridge of the ship. Via the user interface 21 user controllable aspects of the control arrangement 12 may be controlled by personnel. For instance, the user interface 21 may comprise a manually controllable device or autopilot system for setting a setpoint around which propulsion of the ship is controlled.

Via the user interface 21 information from/about the control arrangement 12 may be presented to personnel aboard the ship.

Figure 3:
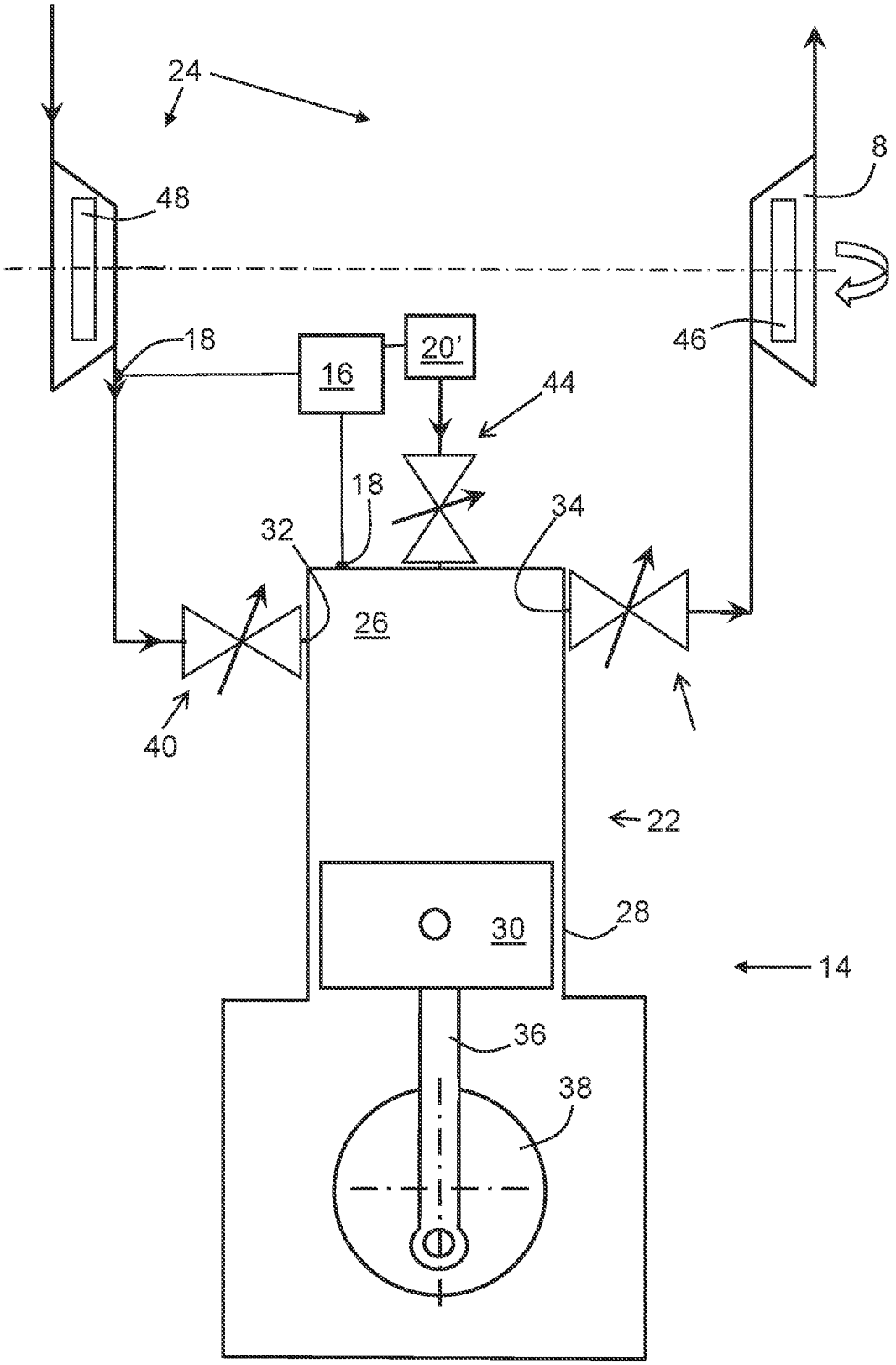

FIG. 3 schematically illustrates a cross section through the ICE 14 shown in FIG. 2. In the following reference is made to the ICE 14. However, the same description may apply to the further ICE 14' in embodiments comprising the further ICE 14'.

The ICE 14 comprises at least one cylinder arrangement 22 and a turbocharger 24. The cylinder arrangement 22 comprises a combustion chamber 26, a cylinder bore 28, a piston 30 configured to reciprocate in the cylinder bore 28, a gas inlet 32 connected to the combustion chamber 26, and a gas outlet 34 connected to the combustion chamber 26. The gas outlet 34 is connected to a turbine side of the turbocharger 24 and the gas inlet 32 is connected to a compressor side of the turbocharger 24. The at least one sensor 18 for sensing at least one operational parameter of the ICE 14 is configured for sensing a parameter of the turbocharger 24, and/or of the cylinder arrangement 22.

A connecting rod 36 connects the piston 30 to a crankshaft 38 of the ICE 14. One or more intake valves 40 are arranged for controlling gas flow through the gas inlet 32. One or more exhaust valves 42 are arranged for controlling gas flow through the gas outlet 34. The intake and exhaust valves 40, 42 are controlled by one common camshaft, or by one camshaft each (not shown). Fuel is injected into the combustion chamber 26 via a fuel injector 44.

Typically, the ICE 14 may comprise any number of cylinder arrangements 22 within the range of 4-20 cylinder arrangements, i.e. the ICE 14 may be a 4-20 cylinder ICE.

In a known manner, the turbocharge 24 comprises a turbine 46, which drives a compressor 48 via a common shaft (not shown). The turbine 46 is driven by exhaust gas ejected from the combustion chamber 26. The compressor 48 compresses fresh gas, typically air, for intake into the combustion chamber 26.

The ICE 14 may comprise more than one turbocharger 24. For instance, the ICE 14 may comprise two turbochargers, each being connected to half of the cylinder arrangements 22 of the ICE 14.

A rotational speed of the turbocharger 24 relates to the rotational speed of the turbine 46, the compressor 48, and the common shaft connecting them.

The ICE 14 has a recommended lower power output level and a recommended upper power output level. The recommended lower and upper power output levels define a power range, within which the ICE 14 may be operated efficiently, and/or reliably, and/or in an environmentally friendly manner, and/or without harming the ICE 14.

Referring to FIGS. 2 and 3, as mentioned above, the control arrangement 12 comprises a control unit 16, at least one sensor 18 for sensing at least one operational parameter of the ICE 14, and at least one power output measuring device 20, 20' of the propulsive power source 4.

The control unit 16 comprises at least one calculation unit which may take the form of substantially any suitable type of processor circuit or microcomputer, e.g. a circuit for digital signal processing (digital signal processor, DSP), a Central Processing Unit (CPU), a processing unit, a processing circuit, a processor, an Application Specific Integrated Circuit (ASIC), a microprocessor, or other processing logic that may interpret and execute instructions. The herein utilised expression "calculation unit" may represent a processing circuitry comprising a plurality of processing circuits, such as, e.g., any, some or all of the ones mentioned above. The control unit 16 comprises a memory unit. The calculation unit is connected to the memory unit, which provides the calculation unit with, for example, the stored programme code and/or stored data which the calculation unit needs to enable it to do calculations. Such data may relate to operational parameters of the ICE 14, data tables related to fuel consumption, rotational speed, and/or power output of the ICE 14, and/or to turbocharger 24 rotational speed, pressures, cylinder pressure, and/or ICE output shaft torque, and/or positions of a fuel rack position sensor, etc.

The calculation unit is also adapted to storing partial or final results of calculations, and/or measured and/or determined parameters in the memory unit, e.g. in tables to be use in calculations or for determining values. The memory unit may comprise a physical device utilised to store data or programs, i.e., sequences of instructions, on a temporary or permanent basis. According to some embodiments, the memory unit may comprise integrated circuits comprising silicon-based transistors. The memory unit may comprise e.g. a memory card, a flash memory, a USB memory, a hard disc, or another similar volatile or non-volatile storage unit for storing data such as e.g. ROM (Read-Only Memory), PROM (Programmable Read-Only Memory), EPROM (Erasable PROM), EEPROM (Electrically Erasable PROM), etc. in different embodiments.

The control unit 16 is further provided with devices for receiving and/or sending input and output signals, respectively. These input and output signals may comprise waveforms, pulses or other attributes which the input signal receiving devices can detect as information and which can be converted to signals processable by the calculation unit.

For instance, the at least one sensor 18 for sensing at least one operational parameter of the ICE 14, and the power output measuring device 20, 20', provide such signals which are received by the input signal receiving devices. These signals are then supplied to the calculation unit. The user interface 21 may send signals to the input signal receiving devices.

The output signal sending devices are arranged to convert calculation results from the calculation unit to output signals for conveying to the component or components for which the signals are intended. Output signal sending device may send control signals for controlling e.g. the operation of the ICE 14 and the further ICE 14', if comprised in the propulsive power source 4, and optionally to a controllable pitch propeller 8. The output signal sending devices may send signals representing data and/or information relating to the operation of the propulsive power source 4 and/or the ICE 14 to the user interface 21.

Each of the connections to the respective devices for receiving and sending input and output signals may take the form of one or more forms selected from among a cable, a data bus, e.g. a CAN (controller area network) bus, a MOST (media orientated systems transport) bus or some other bus configuration, or a wireless connection.

Thus, the control arrangement 12 is configured, under the control of the control unit 16 with input from the at least one sensor 18 for sensing at least one operational parameter of the ICE 14, and the at least one power output measuring device 20, 20' of the propulsive power source 4, to control at least part of the propulsive power source 4 and in particular, the ICE 14, such as the rotational speed and/or power output of the ICE 14.

The control unit 16 is configured to:

Determine a current value of a propulsive power of the propulsive power source 4 utilising the power output measuring device 20, 20'. Thus, the propulsive power that is output by the propulsive power source 4 may be intermittently or continuously monitored.

Determine a current value of an operational parameter of the ICE 14 utilising the at least one sensor 18, the operational parameter being a different parameter than the propulsive power. In this manner, one operational parameter of the ICE 14 may be intermittently or continuously monitored.

Compare the current value of the propulsive power with a lower power limit value.

Compare the current value of the operational parameter with a first parameter limit value. If the current value of the propulsive power equals or falls below the lower power limit value, and/or if the current value of the operational parameter reaches the first parameter limit value, the control unit 16 is configured to:

Increase a power output of the ICE 14.

During operation of the propulsive power source 4, it is controlled based on a setpoint within the available power window of the propulsive power source. The setpoint is chosen by personnel or an autopilot system, e.g. via the user interface 21, and e.g. based on how the ship 2 is to be propelled under its current operating conditions.

The lower power limit value forms a lower setpoint or threshold for the propulsive power output from the propulsive power source 4 to the propeller shaft 6 of the ship 2. The lower power limit value may be a value based on e.g. nautical requirements on the ship, and/or a desired minimum ship speed, and/or a steerageway of the ship. The lower power limit value that is applied in the control arrangement 12 may be defined e.g. based on an idle speed of the ICE 14.

The first parameter limit value forms a threshold for the relevant parameter at which the ICE 14 begins to exhibit operating drawbacks because of the too low a power output of the ICE 14. The first parameter limit value may relate to aspects and/or parameters of the ICE 14 as discussed below with reference to FIG. 4.

For a new or serviced ICE 14 and under ordinary operating conditions of the ship 2, the lower power limit value related to the propulsive power source 4 commonly will be reached before the first parameter limit value related to the ICE 14 is reached. However, under particular operating conditions of the ship, such as e.g. under particular sea and/or weather conditions, and/or under particular operating conditions of the ICE, such as e.g. conditions related to a maintenance status of the ICE 14, and/or fuel energy content, the first parameter limit value may be reached before the lower power limit value is reached.

Mentioned as an example, if certain components of the ICE 14 are not operating properly, a recommended lower power output level of the ICE 14 is reached when the propulsive power source 4 is operated close to, but above, the lower power limit value.

The above discussed configuration of the control unit 16 provides for it to take account of both the above discussed operating conditions in relation to the lower power limit value related to the propulsive power source 4 and the first parameter limit value related to the ICE 14. Since, the control unit 16 is configured to increase the power output of the ICE 14 in response to the current value of the operational parameter reaching the first parameter limit value, it may be ensured that the ICE 14 is not harmed, and/or operated inefficiently, and/or operated in an environmentally harmful manner, due to operation below its lower power output level when the propulsive power source 4 otherwise would be operated close to the lower power limit value.

The power output of the ICE 14 may be increased e.g. by increasing the amount of fuel injected into the cylinders of the ICE 14, and/or in a manner discussed below.

In practice, and purely mentioned as an example, increasing the power output of the ICE 14 in accordance with the present invention may be performed to avoid the following situation: An ICE 14 in the form of a two-stroke diesel engine may comprise electrically-driven auxiliary blowers configured for providing charge air to the cylinders at low engine speeds. Namely, at low engine speeds the turbocharger cannot provide enough air for charging the cylinders. Operation of the propulsive power source 4 with a setpoint close to the lower power limit value may cause the ICE 14 to operate at such low speed that the auxiliary blowers are automatically started. This in turn, will increase the power output of the ICE 14 which produces a higher charge air pressure by the compressor of the turbocharger 24 and causes the auxiliary blower to shut down. The setpoint of the propulsive power source will then reduce the power output and rotational speed of the ICE 14 such that the auxiliary blowers are started again. Hence, the auxiliary blowers will be automatically frequently switched on and off, which is not desirable. Accordingly, in accordance with the invention, the operational parameter of the ICE 14 may be the pressure at the compressor side of the turbocharger 24, and the first parameter limit value may suitably be set at a pressure level just before the auxiliary blowers are started. By determining the current value of an operational parameter, comparing the current value of the operational parameter with the first parameter limit value, and due to the condition "if the current value of the operational parameter reaches the first parameter limit value" being fulfilled, the control unit 16 will increase the power output of the ICE 14. Thus, automatically switching on and off the auxiliary blowers is avoided.

According to embodiments, the control unit 16 optionally may be configured to:

Determine a current value of a further operational parameter of the ICE 14, the further operational parameter being a different parameter than the propulsive power. The further operational parameter is also a different parameter than the above mentioned operational parameter. Thus, the further operational parameter of the ICE 14 may be taken into account in controlling the ICE 14, as discussed below. Further the control unit 16 is configured to:

Compare the current value of the propulsive power with an upper power limit value.

Compare the current value of the operational parameter or a current value of a further operational parameter with a second parameter limit value.

If the current value of the propulsive power equals or exceeds the upper power limit value, and/or if the current value of the operational parameter or the current value of the further operational parameter reaches the second parameter limit value, the control unit 16 is configured to:

Reduce the power output of the ICE 14.

As understood from the discussion above, the second parameter limit value may relate either to the same operational parameter as the first parameter limit value or to a different operational parameter, i.e. the further operational parameter.

The upper power limit value forms an upper setpoint or threshold for the propulsive power output from the propulsive power source 4 to the propeller shaft 6 of the ship 2. The upper power limit value may be a value based on e.g. nautical requirements on the ship, and/or a desired maximum speed, and/or upper power limit related aspects of the propulsive power source, and/or propeller limitations, and/or minimising potential ship and/or cargo damage. The upper power limit value that is applied in the control arrangement 12 may be defined e.g. based on upper power limit related aspects of the propulsive power source, and/or propeller limitations.

The second parameter limit value forms a threshold for the relevant parameter at which the ICE 14 begins to exhibit operating drawbacks because of too high a power output of the ICE 14. The second parameter limit value may relate to aspects and/or parameters of the ICE 14 as discussed below with reference to FIG. 4.

For a new or serviced ICE 14 and under ordinary operating conditions aboard the ship 2, the upper power limit value related to the propulsive power source 4 will be reached before the second parameter limit value related to the ICE 14 is reached. However, under particular operating conditions of the ship, such as e.g. under particular sea and/or weather conditions, and/or under particular operating conditions of the ICE, such as e.g. conditions related to a maintenance status of the ICE 14, and/or fuel energy content, the second parameter limit value may be reached before the upper power limit value is reached.

Mentioned as an example, if certain components of the ICE 14 are not operating properly, a recommended upper power output level of the ICE 14 is reached when the propulsive power source 4 is operated close to, but below, the upper power limit value.

Again, the above discussed configuration of the control unit 16 provides for it to take account of both the above discussed operating conditions. This time in relation to the upper power limit value related to the propulsive power source 4 and the second parameter limit value related to the ICE 14. Since, the control unit 16 is configured to reduce power output of the ICE 14 in response to the current value of the operational parameter, or the further operational parameter, reaching the second parameter limit value, it may be ensured that the ICE 14 is not harmed, and/or operated inefficiently, and/or operated in an environmentally harmful manner due to operation above its upper power output level when the propulsive power source 4 otherwise would be operated close to the upper power limit value.

The power output of the ICE 14 may be reduced by reducing the amount of fuel injected into the cylinders of the ICE 14, and/or in a manner discussed below.

If the current value of the propulsive power of the propulsive power source is determined indirectly utilising the power output measuring device 20, 20', via measuring a parameter of the ICE 14, the determined operational parameter or further operational parameter of the ICE 14, which is compared with the first or second parameter limit value, may be a different parameter of the ICE 14 than the parameter utilised for indirectly determining the current value of the propulsive power.

According to some embodiments, the control arrangement 12 may comprise visual and/or audible indicating means 50. If the current value of the operational parameter reaches the first parameter limit value, the control unit 16 may be configured to:

Increase the lower power limit value.

Indicate via the visual and/or audible indicating means 50 the increase of the lower power limit value. In this manner, the increase in power output of the ICE 14 will be controlled by the control unit 16 mainly based on the condition related to the propulsive power of the propulsive power source 4. Namely, the lower power limit value of the propulsive power source 4 will be reached before the first parameter limit value of the ICE 14 is reached. Moreover, personnel aboard the ship will be made aware of the increased lower power limit value via the visual and/or audible indicating means 50, and may thus, take the ensuing increase of the lower power output of the propulsive power source 4 into account when controlling the ship.

According to some embodiments, as also discussed below with reference to the method 100, the control arrangement 12 may not comprise any visual and/or audible indicating means 50. Thus, the control unit 16 may be configured to increase the lower power output limit value in response to the current value of the operational parameter reaching the first parameter limit value, without indicating the increase of the lower power output limit value.

Mentioned purely as an example, the increase of the lower power limit value may be 0.5%, or 1.0%, or even larger, such as 2-10%, depending on e.g. the maximum power output of the propulsive power source 4, the higher the maximum power output, the lower the increase of the lower power limit value.

The visual and/or audible indicating means 50 may comprise a screen, and/or a lamp, and/or a display, and/or a speaker, and/or a buzzer, and/or similar device for providing visual and/or audible information to personnel aboard the ship 2. The visual and/or audible indicating means 50 may form part of the user interface 21.

The visual and/or audible indicating means 50 may display the actual increase of the lower power limit value in numbers, e.g. percentage of the increase, or the power window of the propulsive power source 4 available after the increase. Alternatively, the visual indicating means 50 may display the increase of the lower power limit value graphically, e.g. by moving a line representing the lower limit of a power window of the propulsive power source 4.

Should under some operating conditions of the ship the first parameter limit value of the ICE 14 again be reached, then the lower power limit value may be further increased.

According to some embodiments, wherein if the current value of the operational parameter or the current value of the further operational parameter reaches the second parameter limit value, the control unit 16 may be configured to:

Reduce the upper power limit value.

Indicate via the visual and/or audible indicating means 50 the reduction of the upper power limit value. In this manner, the reduction of the power output of the ICE 14 will be controlled by the control unit 16 mainly based on the condition related to the propulsive power of the propulsive power source 4. Namely, the upper power limit value of the propulsive power source 4 will be reached before the second parameter limit value of the ICE 14 is reached. Moreover, personnel aboard the ship will be made aware of the reduced upper power limit value via the visual and/or audible indicating means 50, and may thus, take the ensuing reduction of the upper power output of the propulsive power source 4 into account when controlling the ship.

According to some embodiments, as also discussed below with reference to the method 100, the control arrangement 12 may not comprise any visual and/or audible indicating means 50. Thus, the control unit 16 may be configured to reduce the upper power output limit value in response to the current value of the operational parameter reaching the second parameter limit value, without indicating the reduction of the upper power output limit value.

Mentioned purely as an example, the reduction of the upper power limit value may be 0.5%, or 1.0%, or even larger, such as 2-10%, depending on e.g. the maximum power output of the propulsive power source 4, the higher the maximum power output, the lower the reduction of the upper power limit value.

The visual and/or audible indicating means 50 may display the actual reduction of the upper power limit value in numbers, e.g. percentage of the reduction, or the power window of the propulsive power source 4 available after the reduction. Alternatively, the visual indicating means 50 may display the reduction of the upper power limit value graphically, e.g. by moving a line representing the upper limit of a power window of the propulsive power source 4.

Should under some operating conditions of the ship the second parameter limit value of the ICE 14 again be reached, then the upper power limit value may be further reduced.

Initially, the respective lower and upper power limit values may be starting values that are set in accordance with the above discussions. The above discussed increase of the lower power limit value and reduction of the upper power limit value entails that the respective lower and upper power limit values may be adapted to current operating conditions of the ship and/or of the ICE 14. Once normal operating conditions are again established for the ship and/or the ICE 14, one or both of the lower and upper power limit values may be reset to the original starting values, or to new starting values corresponding to new requirements or desires.

According to some embodiments, wherein the propulsive power source 4 comprises the further internal combustion engine 14' connected to the propeller shaft 6, the control unit 16 may be configured to:

Reduce a power output of the further internal combustion engine 14' in order to increase the power output of the internal combustion engine 14. In this manner, the collective power output of the propulsive power source 4 may be maintained while the ICE 14 will be operated with a power output above a power output corresponding to the first parameter limit value.

The reduction of the power output of the further ICE 14', under some circumstances may entail that the further ICE 14' is shut off and/or disconnected from the propeller shaft.

According to some embodiments, wherein the propulsive power source 4 comprises the further internal combustion engine 14' connected to the propeller shaft 6, the control unit 16 may be configured to:

Increase a power output of the further internal combustion engine 14' in order to reduce the power output of the internal combustion engine 14. In this manner, the collective power output of the propulsive power source 4 may be maintained while the ICE 14 will be operated with a power output below a power output corresponding to the second parameter limit value.

The increase of the power output of the further ICE 14', under some circumstances, may entail that the further ICE 14' is started up from a shut off state, and/or connected to the propeller shaft from a disconnected state.

According to some embodiments, the ship may comprise a controllable pitch propeller 8 connected to the propeller shaft 6. The control unit 16 may be configured to:

Reduce a pitch of the controllable pitch propeller 8 in order to reduce the power output of the internal combustion engine 14. In this manner, the load on the ICE 14 is reduced due to the reduced pitch of the controllable pitch propeller 8. Accordingly, a power output of the ICE 14 is below a power output corresponding to the second parameter limit value after reduction of the pitch.

Similarly, the control unit 16 may be configured to:

Increase a pitch of the controllable pitch propeller 8 in order to increase the power output of the ICE 14. In this manner, the load on the ICE 14 may be increased due to the increased pitch of the controllable pitch propeller 8. Accordingly, a power output of the ICE 14 is above a power output corresponding to the first parameter limit value after increasing the pitch.

Controllable pitch propellers are known as such and are not further explained herein.

According to some embodiments, the at least one sensor 18 may be one of:

A rotational speed sensor of the turbocharger 24.

A pressure sensor of the turbocharger 24.

A temperature sensor of the turbocharger 24.

A temperature sensor of the cylinder arrangement 22.

A pressure sensor of the combustion chamber 26. In this manner, the operational parameter and/or the further operational parameter may relate directly or indirectly to one of the parameters measured by such sensors.

As such, the above mentioned sensors are known and will not be explained further herein. The at least one sensor 18 is configured to continuously or intermittently sense and/or measure at least one operational parameter of the ICE 14. The control unit 16 is configured to receive sensed and/or measured data related to the operational parameter from the at least one sensor 18. In this manner, the control unit 16 is configured to determine a current value of an operational parameter of the ICE 14.

In a similar manner, the power output measuring device 20, 20' is configured to continuously or intermittently sense and/or measure at least one parameter or data related to the propulsive power of the propulsive power source 4. The control unit 16 is configured to receive the sensed and/or measured parameter and/or data. In this manner, the control unit 16 is configured to determine a current value of a propulsive power of the propulsive power source 4 utilising the power output measuring device 20, 20'.

In FIGS. 2 and 3 the at least one sensor 18 and the power output measuring device 20, 20' are only schematically indicated. Accordingly, the actual position of the at least one sensor 18 and the power output measuring device 20, 20' in the system 10 depends on the type of sensor and power output measuring device 20, 20', and the parameters to be sensed and/or measured.

Figure 4:
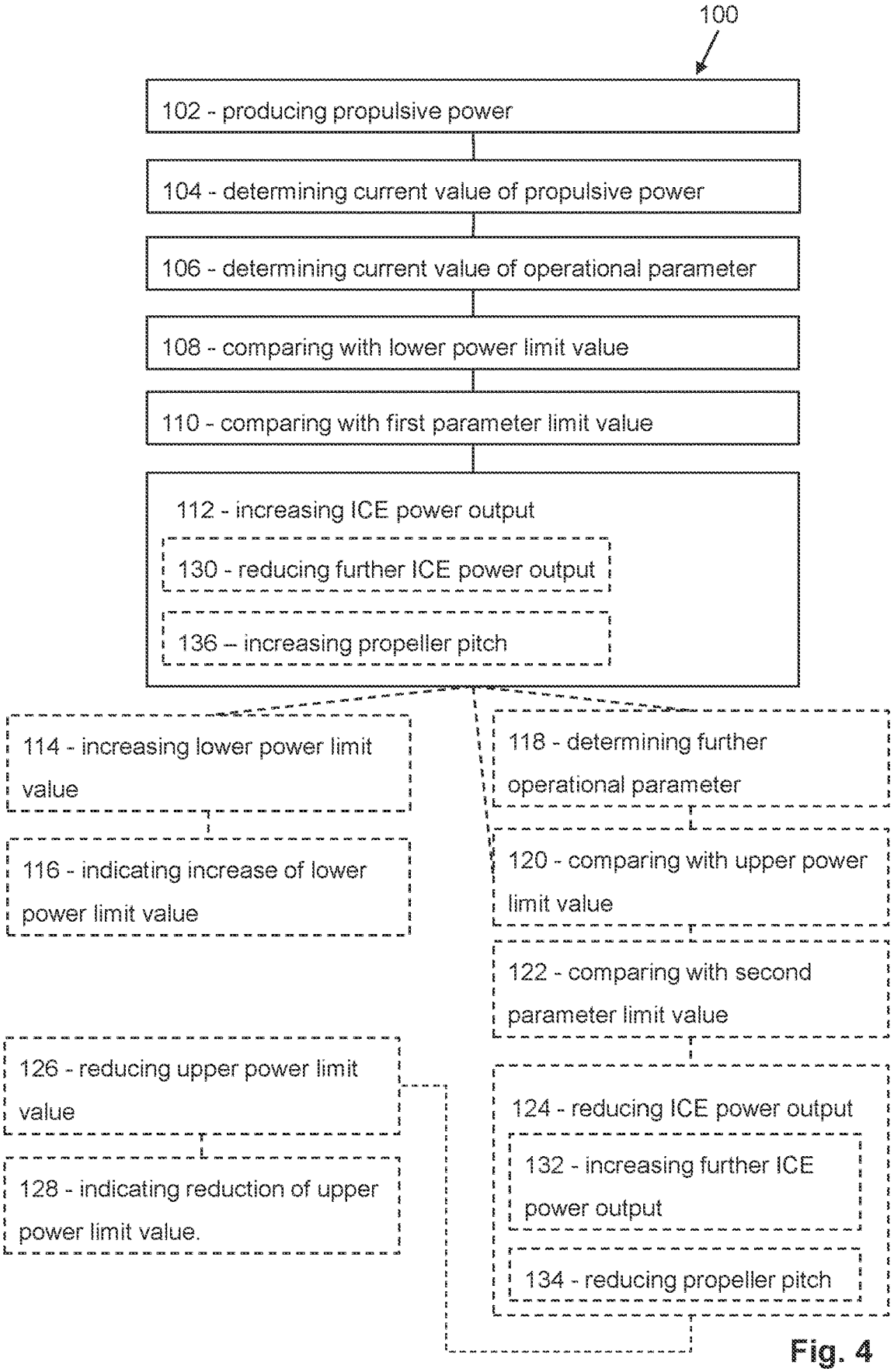
FIG. 4 illustrates a method of controlling a propulsive power output applied to a propeller shaft of a ship.

FIG. 4 illustrates a method 100 of controlling a propulsive power output applied to a propeller shaft of a ship.

The method 100 may be performed in connection with a ship 2 as discussed above with reference to FIG. 1, and a system 10 as discussed above in connection with FIGS. 2 and 3. Accordingly, in the following reference is also made to FIGS. 1-3. Thus, the ship 2 comprises a propulsive power source 4 and the propeller shaft 6. The propulsive power source 4 comprises an ICE 14 connected to the propeller shaft 6.

The method 100 comprises steps of:

Producing 102 a propulsive power by means of the propulsive power source 4.

Determining 104 a current value of the propulsive power of the propulsive power source 4.

Determining 106 a current value of an operational parameter of the ICE 14, the operational parameter being a different parameter than the propulsive power.

Comparing 108 the current value of the propulsive power with a lower power limit value.

Comparing 110 the current value of the operational parameter with a first parameter limit value.

If the current value of the propulsive power equals or falls below the lower power limit value, and/or if the current value of the operational parameter reaches the first parameter limit value, the method 100 comprises a step of:

Increasing 112 a power output of the ICE 14.

As discussed above, in this manner the ICE 14 is prevented from being operated under unfavourable low power output conditions.

According to some embodiments of the method 100, wherein if the current value of the operational parameter reaches the first parameter limit value, the method 100 may comprise a step of:

Increasing 114 the lower power limit value. Thus, the lower power limit value may be adapted to the current operating conditions of the ICE 14.

According to some embodiments of the method 100, wherein the step of increasing 114 the lower power limit has been performed, the method 100 may comprise a step of:

Indicating 116 visually and/or audibly an increase of the lower power limit value. Thus, personnel may be made aware of changed operating conditions of the ship 2.

According to some embodiments of the method 100, the method 100 may comprise an optional step of:

Determining 118 a current value of a further operational parameter of the ICE 14, the further operational parameter being a different parameter than the propulsive power. The method 100 may comprise further steps of:

Comparing 120 the current value of the propulsive power with an upper power limit value, and comparing 122 the current value of the operational parameter or the current value of the further operational parameter with a second parameter limit value.

If the current value of the propulsive power equals or exceeds the upper power limit value, and/or if the current value of the operational parameter or the current value of the further operational parameter reaches the second parameter limit value, the method 100 may comprise a step of:

Reducing 124 a power output of the ICE 14.

As discussed above, in this manner the ICE 14 is prevented from being operated under unfavourable high power output conditions.

According to some embodiments of the method 100, wherein if the current value of the operational parameter or the current value of the further operational parameter reaches the second parameter limit value, the method 100 may comprise a step of:

Reducing 126 the upper power limit value. Thus, the upper power limit value may be adapted to the current operating conditions of the ICE 14.

According to some embodiments of the method 100, wherein the step of reducing the upper power limit value has been performed, the method 100 may comprise a step of:

Indicating 128 visually and/or audibly a reduction of the upper power limit value. Thus, personnel may be made aware of changed operating conditions of the ship 2.

According to some embodiments of the method 100, wherein the propulsive power source 4 comprises a further ICE 14' connected to the propeller shaft 6, the step of increasing 112 the power output of the ICE 14 may comprise a step of:

Reducing 130 a power output of the further ICE 14'. Thus, the step of reducing the power output of the further ICE 14' may provide for the power output of the ICE 14 to be increased in order to maintain the same propulsive power output applied to the propeller shaft 6 of the ship 2 as before the reduction of the power output of the further ICE 14'.

As discussed above with reference to FIGS. 2 and 3, the step of reducing 130 the power output of the further ICE 14' may entail that the further ICE 14' is shut off and/or disconnected from the propeller shaft.

According to some embodiments of the method 100, wherein the propulsive power source 4 comprises a further ICE 14' connected to the propeller shaft 6, the step of reducing 124 a power output of the ICE 14 may comprise a step of:

Increasing 132 a power output of the further ICE 14'. Thus, the step of increasing 132 the power output of the further ICE 14' may provide for the power output of the ICE 14 to be reduced in order to maintain the same propulsive power output applied to the propeller shaft 6 of the ship 2 as before the increase of the power output of the further ICE 14'. As discussed above with reference to FIGS. 2 and 3, the step of increasing 132 the power output of the further ICE 14' may entail that the further ICE 14' is started and/or connected to the propeller shaft.

According to some embodiments, wherein the ship 2 comprises a controllable pitch propeller 8 connected to the propeller shaft 6, the step of reducing 124 the power output of the ICE 14 may comprise a step of:

Reducing 134 a pitch of the controllable pitch propeller 8. In this manner, the load on the ICE 14 and thus, the power output of the ICE 14 may be reduced.

Similarly, according to some embodiments, the step of increasing 112 a power output of the ICE 14 may comprise a step of:

Increasing 136 a pitch of the controllable pitch propeller 8. In this manner, the load on the ICE 14 and thus, the power output of the ICE 14 may be increased.

As discussed above, the operational parameter and/or the further operational parameter may relate to the turbocharger 24 of the ICE 14, and/or to the cylinder arrangement 22 of the ICE 14.

In the following, example operational parameters of the turbocharger 24 and the cylinder arrangement 22 and their use for determining operating conditions of the ICE 14, particularly at its lower and/or upper power output level, will be discussed.

According to some embodiments, the operational parameter and/or the further operational parameter may relate to a power output applied by the ICE 14 to its output shaft. In this context, it may be remarked that the power output applied to the output shaft of the ICE does not necessarily equal the propulsive power applied to the propeller shaft of the ship. One or more transmissions between the output shaft of the ICE and the propeller shaft, and/or one or more power take-off units, PTO:s, connected between the output shaft of the ICE and the propeller shaft may cause the power output applied to the output shaft of the ICE to differ from the propulsive power applied to the propeller shaft.

At least some of the operational parameters discussed below form parameters indirectly related to the power output applied by the ICE 14 to its output shaft.

According to some embodiments, the operational parameter and/or the further operational parameter may relate to one of:

- a rotational speed of the turbocharger 24,
- a temperature at the inlet at the turbine side of the turbocharger 24,
- a temperature at an outlet at the turbine side of the turbocharger 24,
- a pressure at the outlet at the compressor side of the turbocharger 24. In this manner, the operational parameter and/or the further operational parameter may relate to the turbocharger 24.

A low rotational speed of the turbocharger 24 may indicate that the ICE 14 is operating at its lower power output level. Thus, the first parameter limit value may represent a lower rotational speed threshold of the turbocharger 24. The first parameter limit value may be selected such that it is a rotational speed representing a sufficient lower charge air pressure permitting reliable and/or efficient operation of the ICE 14.

A high rotational speed of the turbocharger 24 may indicate that the ICE 14 is operating at its upper power output level. Thus, the second parameter limit value may represent an upper rotational speed threshold of the turbocharger 24. The second parameter limit value may be selected such that the rotational speed of the turbocharger 24 does not exceed a maximum permitted rotational speed of the turbocharger 24.

A high temperature at the inlet at the turbine side of the turbocharger 24 may indicate that the ICE 14 is operating at its upper power output level. Thus, the second parameter limit value may represent an upper temperature threshold at the inlet at the turbine side of the turbocharger 24. The second parameter limit value may be selected such that the temperature at the inlet at the turbine side of the turbocharger 24, which correlates with temperature of the cylinder arrangement, does not exceed a temperature that may cause damage e.g. to part of the cylinder arrangement, or which may cause a thermal overload of the ICE 14.

A high temperature at an outlet at the turbine side of the turbocharger 24 may indicate that the ICE 14 is operating at its lower power output level. A high temperature may indicate that the turbocharger 24 is not operating optimally and that the work extracted from the exhaust gas of the ICE 14 is less than that specified for the turbocharger 24. Thus, the first parameter limit value may represent an upper temperature at the outlet at the turbine side of the turbocharger 24. The first parameter limit value may be selected such that it represents a temperature indicating a particular work extraction from the exhaust gas of the ICE 14.

A low pressure at the outlet at the compressor side of the turbocharger 24 may indicate that the ICE 14 is operating at its lower power output level. Thus, the first parameter limit value may represent a lower pressure threshold at the outlet at the compressor side of the turbocharger 24. The first parameter limit value may be selected such that it represents a sufficient lower charge air pressure at which reliable and/or efficient operation of the ICE 14 is possible.

A high pressure at the outlet at the compressor side of the turbocharger 24 may indicate that the ICE 14 is operating at its upper power output level. Thus, the second parameter limit value may represent an upper pressure threshold of the turbocharger 24. The second parameter limit value may be selected such that the charge air pressure of the turbocharger 24 does not exceed a maximum permitted charge air pressure for the ICE 14.

According to some embodiments, the operational parameter and/or the further operational parameter may relate to one of:

- a temperature of the cylinder arrangement, or
- a pressure within the combustion chamber. In this manner, the operational parameter and/or the further operational parameter may relate to the cylinder arrangement 22.

A high temperature of the cylinder arrangement 22 may indicate that the ICE 14 is operating at its upper power output level. Thus, the second parameter limit value may represent an upper temperature threshold of the cylinder arrangement 22. The second parameter limit value may be selected such that the temperature of the cylinder arrangement 22 does not exceed a temperature that may cause damage e.g. to part of the cylinder arrangement 22, or which may cause a thermal overload of the ICE 14.

A high pressure within the combustion chamber 26 may indicate that the ICE 14 is operating at its upper power output level. Thus, the second parameter limit value may represent an upper pressure threshold within the combustion chamber 26. The second parameter limit value may be selected such that the pressure within the combustion chamber 26 does not cause mechanical or thermal overload on the ICE 14.

According to the invention, the operational parameter, and optionally the further operational parameter, relates to one of:

- a correlation between a rotational speed of the turbocharger 24 and a pressure at the outlet at the compressor side of the turbocharger 24,
- an absolute value of a derivative of the rotational speed of the turbocharger 24,
- a variation of an amplitude of the rotational speed of the turbocharger 24,
- an absolute value of a derivative of the pressure at the outlet at the compressor side of the turbocharger 24,
- a variation of an amplitude of the pressure at the outlet at the compressor side of the turbocharger 24,
- an energy balance over a turbine 46 of the turbocharger 24. In this manner, the operational parameter and/or the further operational parameter may relate to dynamic aspects of the turbocharger 24.

A low or inconsistent correlation between a rotational speed of the turbocharger 24 and a pressure at the outlet at the compressor side of the turbocharger 24, may indicate that the ICE 14 is operating at its upper power output level. A low or inconsistent correlation between the rotational speed of the turbocharger 24 and the pressure at the outlet at the compressor side of the turbocharger 24 may indicate stalling of the turbine of the turbocharger 24, which stalling is undesirable. The second parameter limit value may be selected such that the correlation between a rotational speed of the turbocharger 24 and a pressure at the outlet at the compressor side of the turbocharger 24 does not exceed a particular difference or a particular quotient.

A high absolute value of the derivative of the rotational speed of the turbocharger 24, may indicate that the ICE 14 is operating close to a dynamic upper power output limit, causing pulsating rotation of the turbocharger 24. Dynamic operation of the ICE 14 may be caused e.g. by particular sea conditions, such as the ship traveling through high waves. A high absolute value of the derivative of the rotational speed of the turbocharger 24 indicates quick rotational speed changes of the turbocharger 24. Such quick changes indicate pulsating exhaust gas flow, which in turn may cause stalling of the turbine 46 of the turbocharger 24. A reduction of the power output of the ICE 14 will cause less exhaust gas to be produced in the ICE 14, which in turn reduces the turbocharger rotational speed and pressure on the outlet side of the compressor 48. Thus, rotational speed changes of the turbocharger 24 are reduced. The second parameter limit value may be selected such that stalling of the turbine 46 is prevented during rotational speed changes of the turbocharger 24. A lower second parameter limit value may be selected at a higher mean power output of the ICE 14 than at a lower mean power output of the ICE 14.

The variation of the amplitude of the rotational speed of the turbocharger 24 relates to the difference between the maximum rotational speed and the minimum rotational speed of the turbocharger 24 during pulsating rotation of the turbocharger 24. Pulsating rotation of the turbocharger 24 may be caused e.g. by particular sea conditions, such as the ship traveling through high waves.

A high variation of the amplitude of the rotational speed of the turbocharger 24 may indicate that the ICE 14 is operating at close to a dynamic upper power output limit, causing pulsating rotation of the turbocharger 24. Dynamic operation of the ICE 14 may be caused e.g. by particular sea conditions, such as the ship traveling through high waves. A high variation of the amplitude of the rotational speed of the turbocharger 24 indicates large rotational speed variations of the turbocharger 24. Such large variations indicate pulsating exhaust gas flow, which in turn may cause stalling of the turbine 46 of the turbocharger 24. A reduction of the power output of the ICE 14 will cause less exhaust gas to be produced in the ICE 14, which in turn reduces the turbocharger rotational speed and pressure on the outlet side of the compressor 48. Thus, rotational speed changes of the turbocharger 24 are reduced. The second parameter limit value may be selected such that stalling of the turbine 46 is prevented during rotational speed changes of the turbocharger 24. A lower second parameter limit value may be selected at a higher mean power output of the ICE 14 than at a lower mean power output of the ICE 14.

A high absolute value of a derivative of the pressure at the outlet at the compressor side of the turbocharger 24, may indicate that the ICE 14 is operating close to a dynamic upper power output limit, causing pulsating rotation of the turbocharger 24. Dynamic operation of the ICE 14 may be caused e.g. by particular sea conditions, such as the ship traveling through high waves. A high absolute value of the derivative of the pressure at the outlet at the compressor side of the turbocharger 24 indicates quick rotational speed changes of the turbocharger 24. Such quick changes indicate pulsating exhaust gas flow, which in turn may cause stalling of the turbine 46 of the turbocharger 24. A reduction of the power output of the ICE 14 will cause less exhaust gas to be produced in the ICE 14, which in turn reduces the turbocharger rotational speed and pressure on the outlet side of the compressor 48. Thus, pressure changes at the outlet at the compressor side of the turbocharger 24 are reduced. The second parameter limit value may be selected such that stalling of the turbine 46 is prevented during pressure changes at the outlet at the compressor side of the turbocharger 24. A lower second parameter limit value may be selected at a higher mean power output of the ICE 14 than at lower mean power output of the ICE 14.

The variation of the amplitude of the pressure at the outlet at the compressor side of the turbocharger 24 relates to the difference between the maximum pressure and the minimum pressure at the outlet at the compressor side of the turbocharger 24 during pulsating rotation of the turbocharger 24. Pulsating rotation of the turbocharger 24 may be caused e.g. by particular sea conditions, such as the ship traveling through high waves.

A high variation of the amplitude of the pressure at the outlet at the compressor side of the turbocharger 24 may indicate that the ICE 14 is operating close to a dynamic upper power output limit, causing pulsating rotation of the turbocharger 24. Dynamic operation of the ICE 14 may be caused e.g. by particular sea conditions, such as the ship traveling through high waves. A high variation of the amplitude of the pressure at the outlet at the compressor side of the turbocharger 24 indicates large pressure variations at the outlet at the compressor side of the turbocharger 24. Such large variations indicate pulsating exhaust gas flow, which in turn may cause stalling of the turbine 46 of the turbocharger 24. A reduction of the power output of the ICE 14 will cause less exhaust gas to be produced in the ICE 14, which in turn reduces the turbocharger rotational speed and pressure on the outlet side of the compressor 48. Thus, rotational speed changes of the turbocharger 24 are reduced. The second parameter limit value may be selected such that stalling of the turbine 46 is prevented during pressure changes of the turbocharger 24. A lower second parameter limit value may be selected at a higher mean power output of the ICE 14 than at a lower mean power output of the ICE 14.

A low energy balance over the turbine 46 may indicate that the ICE 14 is operating at its lower output limit. Thus, the first parameter limit value may represent a lower energy extraction threshold of the turbocharger 24. The first parameter limit value may be selected such that it represents a sufficiently high energy extraction in the turbine 46 of the turbocharger 24. By measuring temperature and pressure at both the inlet side and the outlet side of the turbine 46, the energy extracted in the turbine 46 may be calculated and compare with one or more expected energy extraction values, representing the first parameter limit value.

One skilled in the art will appreciate that the method 100 of controlling a propulsive power output applied to a propeller shaft of a ship may be implemented by programmed instructions. These programmed instructions are typically constituted by a computer program, which, when it is executed in a computer or control unit, ensures that the computer or control unit carries out the desired control, such as at least some of the method steps 102-134 according to the invention. The computer program is usually part of a computer programme product which comprises a suitable digital storage medium on which the computer program is stored.

Naturally, more than one or two of the above discussed operational parameters and/or other operational parameters of the ICE 14 may be determined and compared to respective parameter limit values. Whereas under some conditions a particular operational parameter may indicate that the ICE 14 is operated at its lower or upper power output level, under other conditions a different operational parameter may indicate that the ICE 14 is operated at its lower or upper power output level.

Figure 5:
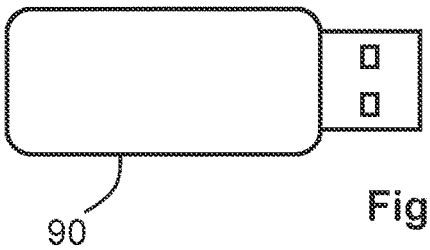
FIG. 5 illustrates a computer-readable storage medium according to embodiments.

FIG. 5 illustrates embodiments of a computer-readable storage medium 90 comprising instructions which, when executed by a computer, cause the computer to carry out the steps of the method 100 according to any one of aspects and/or embodiments discussed herein.

The computer-readable storage medium 90 may be provided for instance in the form of a data carrier carrying computer program code for performing at least some of the steps 102-134 according to some embodiments when being loaded into the one or more calculation units of the control unit 16. The data carrier may be, e.g. a ROM (read-only memory), a PROM (programmable read-only memory), an EPROM (erasable PROM), a flash memory, an EEPROM (electrically erasable PROM), a hard disc, a CD ROM disc, a memory stick, an optical storage device, a magnetic storage device or any other appropriate medium such as a disk or tape that may hold machine readable data in a non-transitory manner. The computer-readable storage medium 90 may furthermore be provided as computer program code on a server and may be downloaded to the control unit 16 remotely, e.g., over an Internet or an intranet connection, or via other wired or wireless communication systems.

The computer-readable storage medium 90 shown in FIG. 5 is a nonlimiting example in the form of a USB memory stick.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the invention, as defined by the appended claims.

The invention claimed is:

1. A method of controlling a propulsive power output applied to a propeller shaft of a ship, the ship comprising a propulsive power source and the propeller shaft, wherein the propulsive power source comprises an internal combustion engine connected to the propeller shaft, wherein the method comprises steps of:

producing a propulsive power by means of the propulsive power source, determining a current value of an operational parameter of the internal combustion engine, the operational parameter being a different parameter than the propulsive power, comparing the current value of the operational parameter with a first parameter limit value, wherein the internal combustion engine comprises at least one cylinder arrangement and a turbocharger, wherein the cylinder arrangement comprises a combustion chamber, a cylinder bore, a piston configured to reciprocate in the cylinder bore, a gas inlet connected to the combustion chamber, and a gas outlet connected to the combustion chamber, wherein the gas outlet is connected to a turbine side of the turbocharger and the gas inlet is connected to a compressor side of the turbocharger, wherein at least one sensor for sensing at least one operational parameter of the internal combustion engine is configured for sensing a parameter of the turbocharger, characterised in that the operational parameter is one of:

an absolute value of a derivative of a rotational speed of the turbocharger, a variation of an amplitude of the rotational speed of the turbocharger, an absolute value of a derivative of a pressure at the outlet at the compressor side of the turbocharger, a variation of an amplitude of the pressure at the outlet at the compressor side of the turbocharger, an energy balance over a turbine of the turbocharger, wherein the method comprises steps of:

determining a current value of the propulsive power of the propulsive power source, comparing the current value of the propulsive power with a lower power limit value, and wherein if the current value of the propulsive power equals or falls below the lower power limit value, but also if the current value of the operational parameter reaches the first parameter limit value, the method comprises a step of:

increasing a power output of the internal combustion engine.

2. The method according to claim 1, wherein if the current value of the operational parameter reaches the first parameter limit value, the method comprises a step of:

increasing the lower power limit value.

3. The method according to claim 2, comprising a step of:

indicating visually and/or audibly an increase of the lower power limit value.

4. The method according to claim 1, comprising a step of:
determining a current value of a further operational parameter of the internal combustion engine, the further operational parameter being a different parameter than the propulsive power, wherein
the method comprises steps of:
comparing the current value of the propulsive power with an upper power limit value, and
comparing the current value of the operational parameter or the current value of the further operational parameter with a second parameter limit value, wherein
if the current value of the propulsive power equals or exceeds the upper power limit value, but also if the current value of the operational parameter or the current value of the further operational parameter reaches the second parameter limit value, the method comprises a step of:
reducing the power output of the internal combustion engine.

5. The method according to claim 4, wherein if the current value of the operational parameter or the current value of the further operational parameter reaches the second parameter limit value, the method comprises a step of:
reducing the upper power limit value.

6. The method according to claim 5, comprising a step of:
indicating visually and/or audibly a reduction of the upper power limit value.

7. The method according to claim 4, wherein the propulsive power source comprises a further internal combustion engine connected to the propeller shaft, wherein
the step of increasing the power output of the internal combustion engine comprises a step of:
reducing a power output of the further internal combustion engine.

8. The method according to claim 7, wherein the step of reducing a power output of the internal combustion engine comprises a step of:
increasing a power output of the further internal combustion engine.

9. The method according to claim 4, wherein the ship comprises a controllable pitch propeller connected to the propeller shaft, and wherein the step of reducing the power output of the internal combustion engine comprises a step of:
reducing a pitch of the controllable pitch propeller.

10. The method according to claim 4, wherein the further operational parameter relates to the turbocharger, and/or to the cylinder arrangement.

11. The method according to claim 10, wherein the further operational parameter is one of:
a rotational speed of the turbocharger,
a temperature at the inlet at the turbine side of the turbocharger,
a temperature at an outlet at the turbine side of the turbocharger,
a pressure at the outlet at the compressor side of the turbocharger.

12. The method according to claim 10, wherein the further operational parameter is one of:
a temperature of the cylinder arrangement, or
a pressure within the combustion chamber.

13. The method according to claim 10, wherein the further operational parameter is one of:
an absolute value of a derivative of the rotational speed of the turbocharger,
a variation of an amplitude of the rotational speed of the turbocharger,
an absolute value of a derivative of the pressure at the outlet at the compressor side of the turbocharger,
a variation of an amplitude of the pressure at the outlet at the compressor side of the turbocharger,
an energy balance over a turbine of the turbocharger.

14. A system for controlling a propulsive power output applied to a propeller shaft of a ship, the system comprising a propulsive power source and a control arrangement, wherein
the propulsive power source comprises an internal combustion engine connected to the propeller shaft, wherein
the control arrangement comprises a control unit, at least one sensor for sensing at least one operational parameter of the internal combustion engine, and wherein
the control unit is configured to:
determine a current value of an operational parameter of the internal combustion engine utilising the at least one sensor, the operational parameter being a different parameter than the propulsive power, and
compare the current value of the operational parameter with a first parameter limit value, wherein
the internal combustion engine comprises at least one cylinder arrangement and a turbocharger, wherein
the cylinder arrangement comprises a combustion chamber, a cylinder bore, a piston configured to reciprocate in the cylinder bore, a gas inlet connected to the combustion chamber, and a gas outlet connected to the combustion chamber, wherein
the gas outlet is connected to a turbine side of the turbocharger and the gas inlet is connected to a compressor side of the turbocharger, wherein
the at least one sensor for sensing at least one operational parameter of the internal combustion engine is configured for sensing a parameter of the turbocharger, characterised in that
the operational parameter is one of:
an absolute value of a derivative of a rotational speed of the turbocharger,
a variation of an amplitude of the rotational speed of the turbocharger,
an absolute value of a derivative of a pressure at the outlet at the compressor side of the turbocharger,
a variation of an amplitude of the pressure at the outlet at the compressor side of the turbocharger,
an energy balance over a turbine of the turbocharger, wherein
the control arrangement comprises at least one power output measuring device of the propulsive power source, wherein
the control unit is configured to:
determine a current value of a propulsive power of the propulsive power source utilising the power output measuring device, and
compare the current value of the propulsive power with a lower power limit value, and wherein
if the current value of the propulsive power equals or falls below the lower power limit value, but also if the current value of the operational parameter reaches the first parameter limit value, the control unit is configured to:
increase a power output the internal combustion engine.

15. The system according to claim 14, wherein the control unit is configured to:

determine a current value of a further operational parameter of the internal combustion engine, the further operational parameter being a different parameter than the propulsive power, wherein the control unit is configured to:

compare the current value of the propulsive power with an upper power limit value, and compare the current value of the operational parameter or a current value of a further operational parameter with a second parameter limit value, wherein if the current value of the propulsive power equals or exceeds the upper power limit, but also if the current value of the operational parameter or the current value of the further operational parameter reaches the second parameter limit value, the control unit is configured to:

reduce a power output of the internal combustion engine.

16. The system according to claim 14, wherein the at least one sensor for sensing at least one operational parameter of the internal combustion engine is configured for sensing a parameter of the cylinder arrangement.

17. The system according to claim 15, wherein the control arrangement comprises visual and/or audible indicating means, wherein if the current value of the operational parameter reaches the first parameter limit value, the control unit is configured to:

increase the lower power limit value, and indicate via the visual and/or audible indicating means the increase of the lower power limit value.

18. The system according to claim 17, wherein if the current value of the operational parameter or the current value of the further operational parameter reaches the second parameter limit value, the control unit is configured to:

reduce the upper power limit value, and indicate via the visual and/or audible indicating means a reduction of the upper power limit value.

19. The system according to claim 14, wherein the propulsive power source comprises a further internal combustion engine connected to the propeller shaft, wherein the control unit is configured to reduce a power output of the further internal combustion engine in order to increase the power output of the internal combustion engine.

20. The system according to claim 19, wherein the control unit is configured to increase a power output of the further internal combustion engine in order to reduce the power output of the internal combustion engine.

21. The system according to claim 15, wherein the ship comprises a controllable pitch propeller connected to the propeller shaft, and wherein the control unit is configured to reduce a pitch of the controllable pitch propeller in order to reduce the power output of the internal combustion engine.

22. The system according to claim 16, wherein the at least one sensor is one of:

a rotational speed sensor of the turbocharger, a pressure sensor of the turbocharger, a temperature sensor of the turbocharger, a temperature sensor of the cylinder arrangement, a pressure sensor of the combustion chamber.

23. A computer program comprising instructions which, when the program is executed by a computer, cause the computer to carry out the steps of the method according to claim 1.

24. A computer-readable storage medium comprising instructions which, when executed by a computer, cause the computer to carry out the steps of the method according to claim 1.

* * * * *